US009255745B2

(12) United States Patent
Bertolotti et al.

(10) Patent No.: US 9,255,745 B2
(45) Date of Patent: Feb. 9, 2016

(54) HEAT EXCHANGER

(75) Inventors: Fabio P. Bertolotti, South Windsor, CT (US); Daniel R. Sabatino, East Hamptom, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1953 days.

(21) Appl. No.: 12/348,582

(22) Filed: Jan. 5, 2009

(65) Prior Publication Data

US 2010/0170667 A1 Jul. 8, 2010

(51) Int. Cl.

| | |
|---|---|
| ***F28F 3/00*** | (2006.01) |
| ***F28F 1/12*** | (2006.01) |
| ***F28F 3/02*** | (2006.01) |
| ***F28F 13/06*** | (2006.01) |

(52) U.S. Cl.

CPC ..... *F28F 1/124* (2013.01); *F28F 3/022* (2013.01); *F28F 13/06* (2013.01); *Y10T 29/4935* (2015.01)

(58) Field of Classification Search

USPC ..... 165/164, 181

See application file for complete search history.

(56) References Cited

U.S. PATENT DOCUMENTS

| | | | | |
|---|---|---|---|---|
| 1,929,365 | A * | 10/1933 | Mautsch | 165/175 |
| 1,949,041 | A * | 2/1934 | De Lagabbe | 181/239 |
| 1,958,364 | A * | 5/1934 | Govers | 165/180 |
| 2,678,808 | A | 5/1954 | Gier, Jr. | |
| 3,741,285 | A * | 6/1973 | Kuethe | 165/181 |
| 4,821,389 | A | 4/1989 | Nelson | |
| 4,886,018 | A * | 12/1989 | Ferroli | 122/367.3 |
| 4,993,487 | A * | 2/1991 | Niggemann | 165/164 |
| 5,154,679 | A | 10/1992 | Fuller et al. | |
| 5,193,611 | A * | 3/1993 | Hesselgreaves | 165/165 |
| 5,512,250 | A | 4/1996 | Betta et al. | |
| 5,832,993 | A | 11/1998 | Ohata et al. | |
| 5,884,691 | A | 3/1999 | Batchelder | |
| 6,167,952 | B1 | 1/2001 | Downing | |
| 6,520,252 | B1 | 2/2003 | Bizzarro | |
| 7,111,672 | B2 * | 9/2006 | Symonds | 165/165 |
| 7,278,474 | B2 | 10/2007 | Valenzuela et al. | |
| 7,302,998 | B2 | 12/2007 | Valenzuela | |
| 7,353,864 | B2 | 4/2008 | Zaffetti et al. | |
| 2004/0194936 | A1 * | 10/2004 | Torii | 165/151 |
| 2008/0066888 | A1 | 3/2008 | Tong et al. | |
| 2009/0145581 | A1 * | 6/2009 | Hoffman et al. | 165/80.3 |
| 2009/0151920 | A1 * | 6/2009 | Polcyn | 165/185 |
| 2009/0314474 | A1 * | 12/2009 | Kimbara et al. | 165/104.33 |

FOREIGN PATENT DOCUMENTS

| | | | |
|---|---|---|---|
| GB | 2122738 | A | 1/1984 |
| JP | 55-122077 | | 8/1980 |
| JP | 61-74784 | | 5/1986 |
| JP | 1-217193 | | 8/1989 |
| WO | 9737187 | A1 | 10/1997 |
| WO | 2005033607 | A1 | 4/2005 |

OTHER PUBLICATIONS

European Search Report for European Patent Application No. 10250006.3 dated Nov. 28, 2013.

* cited by examiner

*Primary Examiner* — Marc Norman
*Assistant Examiner* — Devon Russell
(74) *Attorney, Agent, or Firm* — Carlson, Gaskey & Olds, P.C.

(57) ABSTRACT

A heat exchanger has a fluid passage sharing a wall with a cooling fluid passage adjacent to the passage. The thermally conductive wall allows heat to be transferred from the fluid into the cooling fluid passage. The passage additionally has a set of at least one airfoil pin extending into the passage.

6 Claims, 2 Drawing Sheets

HEAT EXCHANGER

BACKGROUND OF THE INVENTION

The present application is related to a pin fin heat exchanger with pins having an airfoil profile.

Heat exchangers capable of drawing heat from one place and dissipating it in another place are well known in the art and are used in numerous applications where efficiently removing heat is desirable. One type of heat exchanger used in fluid cooling systems dissipates heat from two parallel fluid passages into a cooling fluid passage between the passages. A cooling fluid (such as air) is then passed through the cooling fluid passage. Heat from the parallel fluid passages is drawn into the cooling fluid passage and is expelled at the opposite end of the heat exchanger with the cooling fluid. Heat exchangers of this type are often used in vehicle applications such as aircraft engines or car engines.

Devices constructed according to this principle transfer heat from the surface area of the parallel passages into the fluid flowing through the cooling fluid passage. In order to increase the surface area which is capable of dissipating heat, some heat exchangers have added pins extending from the walls of the parallel fluid passages into the air gap. The pins are thermally conductive and thus heat can be conducted from the passages into the pins and dissipated into the cooling fluid. The pins can be held in place using crossed ligaments. A device according to the above described design is referred to as a pin fin heat exchanger. The ligaments also provide more surface area which the fluid being forced through the cooling fluid passage is exposed to, and thereby allow a greater dissipation of heat. Some designs in the art utilize pins where each pin is connected to both of the parallel fluid passages resulting in a post running perpendicular to the parallel fluid passages through the gap. Current heat exchangers using pins have a symmetrical pin profile such as a circular or diamond profile.

SUMMARY OF THE INVENTION

Disclosed is a heat exchanger having pins connecting extending from a wall of a fluid passage into a cooling fluid passage. The pins conduct heat from the fluid passage into a cooling fluid passage adjacent to the wall. A cooling fluid flows through the gap and heat is dissipated from the pins and the wall into the fluid. The pins have an airfoil profile.

These and other features of the present invention can be best understood from the following specification and drawings, the following of which is a brief description.

DETAILED DESCRIPTION OF THE PREFERRED EMBODIMENT

Figure 1:
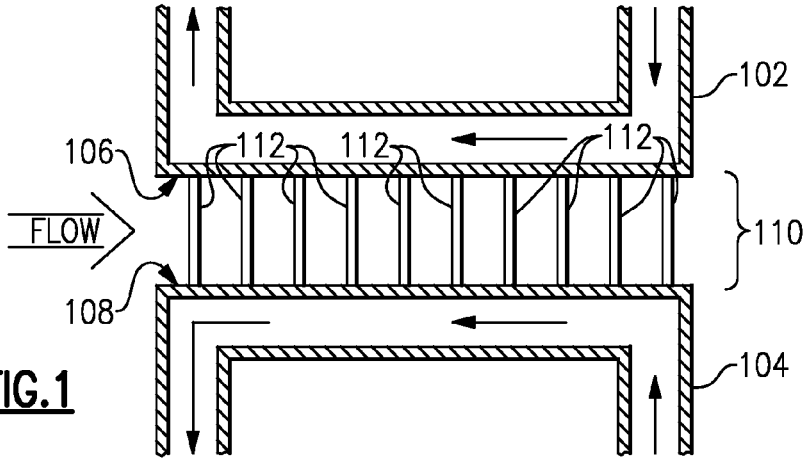
FIG. 1 is an illustration of a cut-out side view of an example heat exchanger.

A simplified heat exchange system according to the present application is illustrated in FIG. 1. Two parallel fluid passages

102, 104 have facing outer walls 106, 108 and a cooling fluid passage 110 between the facing outer walls 106, 108. A cooling fluid such as air, which is initially cooler than the facing outer walls 106, 108, passes through the cooling fluid passage 110. While traveling through the cooling fluid passage 110 the cooling fluid absorbs heat from the exposed surface area of the facing outer walls 106, 108 thereby cooling the fluid traveling through the parallel fluid passages 102, 104.

In order to increase the surface area exposed to the cooling fluid in the cooling fluid passage 110, and thereby increase the heat transfer potential of the heat exchanger, thermally conductive pins 112 connect the facing surfaces 106, 108 of the fluid passages 102, 104. The pins 112 conduct heat from the facing surfaces 106, 108 into the cooling fluid passage 110, thereby exposing more surface area to the cooling fluid flowing through the cooling fluid passage 110. Since the amount of heat dissipated in the heat exchanger is proportional to the surface area exposed to the cooling fluid, and the pins generate more exposed surface area, the efficiency of the heat exchanger is increased.

Previous pin fin heat exchanger designs used a circular, diamond, or other symmetrical shape for the pin 112 profile. In previous designs, when a cooling fluid flowing through the cooling fluid passage 110 in one direction hits the side of a symmetrical pin, the cooling fluid is naturally forced around the pin. It is well known in the art that the flow path can be either attached to surface, whereby the flow path near the wall is moving parallel to the wall and provides effective heat transfer, or separated from the surface, whereby the flow path is not necessarily parallel to the wall and does not provides effective heat transfer. In the process of flowing around the pin, the cooling fluid flow path becomes separated from the surface of the pin, resulting in the cooling fluid flow remaining attached to as little as half of the pin's surface area. Consequently, only the portion of the surface area of the pin contacting the flow path can provide heat dissipation and the remainder of the pin's surface area is wasted.

Figure 2:
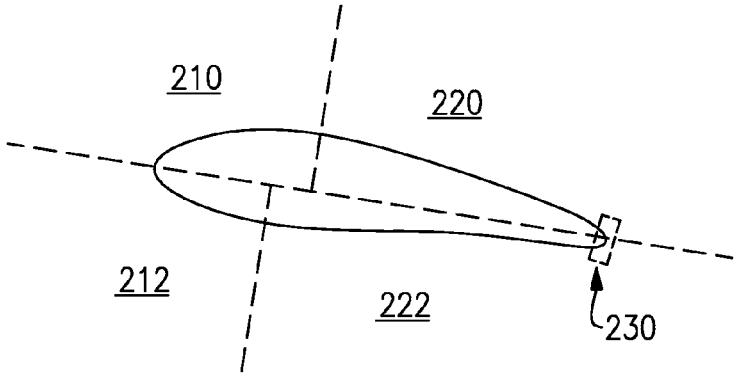
FIG. 2 is an illustration of an airfoil profile in an example heat exchanger.

FIG. 2 illustrates a profile of a pin 112 design where the profile is airfoil. Airfoil profiles are well known in the field of aircraft design, where they are used to control airflow over the wings and thereby generate lift. It is also known that the curvature of the wing shape may be altered to reduce or adjust the flow separation of an airflow flowing over the wing of an aircraft. In addition to the curvature of the wing, aircraft designs utilize an angle of attack. The angle of attack is the angle of the wing with respect to the fluid flow. Determining the proper angle of attack in order to avoid stalling is well known in aircraft design. The profile illustrated in FIG. 2 applies these features of aircraft wing design to the pin profile design in a heat exchanger.

The airfoil pin 112 profile in FIG. 2 has an upper acceleration region 210, an upper deceleration region 220, a lower acceleration region 212, and a lower deceleration region 222. When a cooling fluid flows over the upper acceleration region 210 and the lower acceleration region 212 of the pin, the cooling fluid flow will accelerate. Once the fluid enters the upper deceleration region 220 and the lower deceleration region 222 of the pin, the cooling fluid flow begins to decelerate. Flow separation typically only occurs on an airfoil profile when the cooling fluid flow is in the deceleration regions 220, 222 near the trailing edge 230. Since the surface area of the trailing edge 230 is a smaller portion of the surface area of the pin 112 than the flow separation region of a circular or other symmetrical profile, the airfoil profile allows the pin 112 to more efficiently utilize its surface area, thereby dissipating a larger amount of heat.

Figure 3:
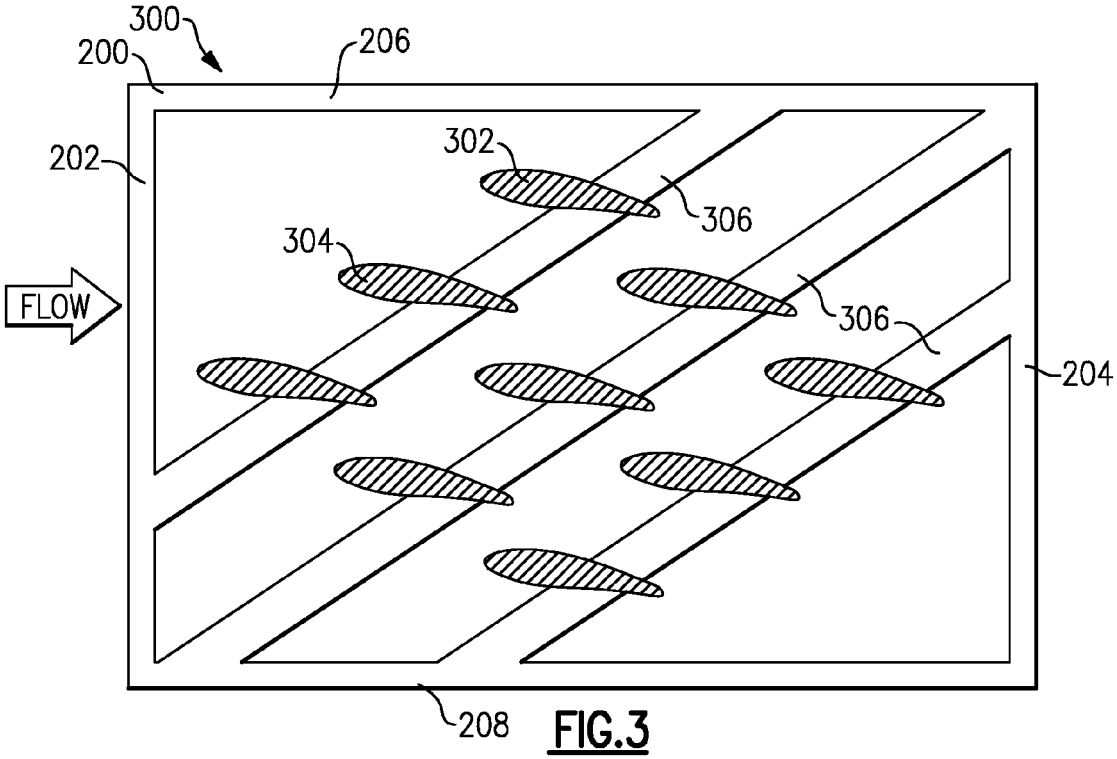
FIG. 3 is an array of pins and ligaments for an example heat exchanger.

FIG. 3 shows an example embodiment of a heat exchanger using airfoil pins 112 that also incorporates ligaments 306 connecting a portion of the pins 302, 304 in a pin array 300 together. The ligaments 306 are connected between the lower deceleration region 222 of a first pin 302 and the upper deceleration region 220 of a second pin 304. The ligament 306 attaches multiple pins 302, 304 to each other in a similar manner, resulting in an array 300 of pins 302, 304 and ligaments 306. It is additionally possible to connect each end of the ligaments 306 to a frame 200 which holds the ligaments 306 and the pins 302, 304 in place. The frame 200 and the ligaments 306 can be constructed out of a single unit. Alternately, the ligaments 306 can be connected to the frame 200 using any other known method, depending on design constraints. The frame 200 can have four sides as depicted in FIG. 3, or can be created without flow facing sides 202, 204. In an embodiment without flow facing sides each of the ligaments would be connected to at least one of the sides 206, 208 which are parallel to cooling fluid flow.

An additional advantage realized by the placement of the ligaments 306 in the cooling fluid passage 110 arises from the natural interference with the cooling fluid flow caused by the ligaments 306. When the cooling fluid flow contacts the ligaments 306 a wake zone is created behind the ligament 306. The wake zone causes turbulence in the cooling fluid which mixes the cooling fluid which was directly in the cooling fluid flow path with cooling fluid that was not directly in the cooling fluid flow path.

Mixing the cooling fluid in the cooling fluid flow path with the cooling fluid not directly in the cooling fluid flow path provides a beneficial dispersal of the heated cooling fluid from the direct flow path into the unheated cooling fluid not directly in the cooling fluid flow path. The mixing effect thereby increases the efficiency of the heat exchanger as it allows the cooling fluid directly in the fluid flow path to have a reduced temperature farther into the cooling fluid passage 110 than previous designs.

Figure 4:
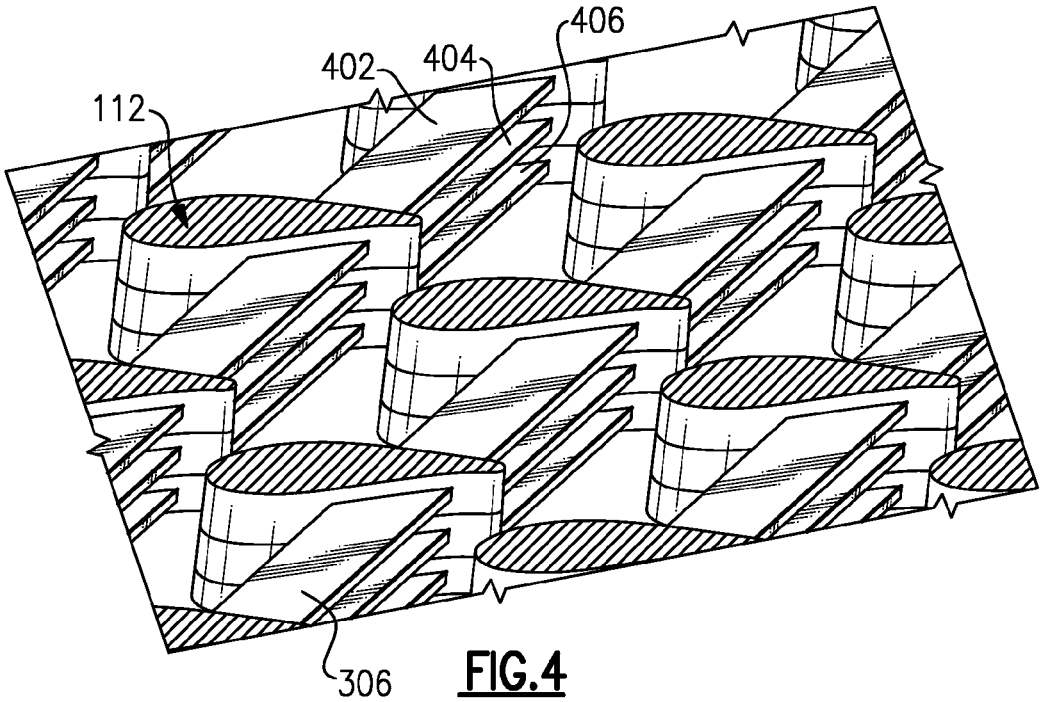
FIG. 4 is an isometric view of an example construction of a pin and ligament array.

An example construction for the array of pins 112 and ligaments 306 is disclosed in FIG. 4. The example embodiment of FIG. 4 illustrates a pin fin array created using a stamping or etching process to form the ligaments 306 and portions of each pin 112 out of a sheet of metal or other thermally conductive material. The frame may also be formed out of the same sheet using the same method. In the etching process, a profile of the ligaments 306, the pins 112 and the frame is etched or stamped out of the sheet. Once the profile has been created, the ligament portion 306 is etched to be thinner than the pin 112 portion. By way of example the pin 112 portion could be 1 mm thick, and the ligament 306 portion could be 0.3 mm thick. Additionally the frame can be etched to connect to, or interlock with, other stacked frame portions thereby creating a completed unit. Additional sheets are also created using the same method resulting in multiple stackable sheets 402, 404, 406.

Once each sheet 402, 404, 406 has been etched to the proper shape and thickness, the sheets 402, 404, 406 are stacked on top of each other (illustrated in FIG. 4), with the number of sheets 402, 404, 406 being stacked depending on the pin height necessary for the particular application. Once stacked, the pin profile portions of the sheet are bonded together using any known bonding method to form solid pins 112 comprising multiple sheets 402, 404, 406 and connected to multiple ligaments 306. The stacked array 300 of pins 112 and ligaments 306 is then placed in the cooling fluid passage 110 with the top of the pins 112 contacting the first facing wall 106, and the bottom of the pins 112 contacting the second facing wall 108. The array 300 may be held in place using a frame or any other known method. Since the ligament 306 portion of the etched sheet is thinner than the pin 112 profile portion, cooling fluid is allowed to flow between the ligaments 306 and through the cooling fluid passage 110.

In addition to providing more surface area through which heat can be dissipated, including additional ligaments 306 creates a restriction in the flow passage because the ligaments 306 block a portion of the flow. The restriction decreases the space through which the fluid can flow, thus causing flow acceleration and a decrease in flow pressure through the cooling fluid passage 110. By design, this decrease occurs in the deceleration regions 220 and 222, thereby this decrease in flow pressure results in less flow separation. A design taking advantage of the lower flow separation could be used in an application where the fluid flow pressure drop is not a significant design constraint.

Figure 5:
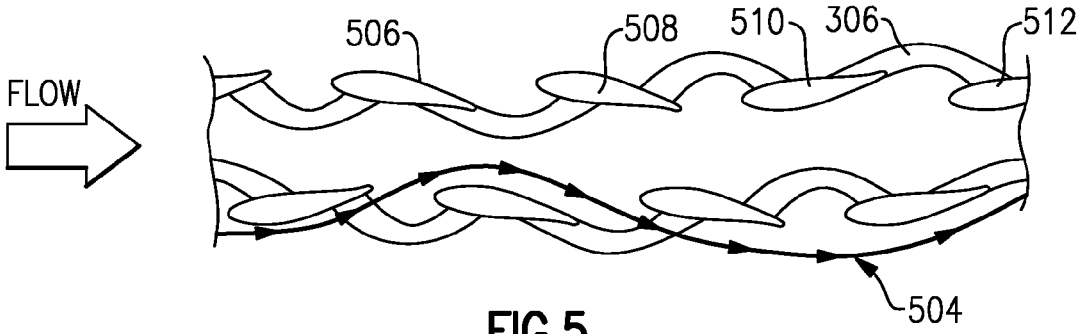
FIG. 5 is an example array of pins and ligaments where the angles of attack of the pins are arranged to control the flow of a cooling fluid.

Another example embodiment, illustrated in FIG. 5, utilizes the airfoil profile of the pins 112 to control and direct the flow path 504 of the cooling fluid, thereby minimizing the pressure drop, or controlling any other desired attribute. In FIG. 5, the ligaments 306 connect the lower deceleration region 222 of a first pin 506 with the lower acceleration region of a second pin 508. This design also uses different angles of attack for each pin in order to shape the flow of the cooling fluid through the cooling fluid passage 110. The example method of FIG. 5 utilizes a pattern where two pins 506, 508 are angled in a first direction relative to fluid flow are followed by two pins 510, 512 angled in a second direction opposite the first direction relative to fluid flow with the pattern repeating itself. A line illustrates a flow path 504 of the cooling fluid resulting from the angled pin pattern as the cooling fluid flows through the cooling fluid passage 110. With this flow path 504 the fluid has a farther distance to travel before it hits another pin than a pattern with conventional pin profiles, thereby allowing heated cooling fluid to mix with non-heated cooling fluid longer before hitting another pin. The mixing of the cooling fluid provides for better heat absorption rates of the fluid itself. In order to achieve a desired mixing level, the ligaments can be arranged to interfere with the fluid flow as much or as little as is required for a particular application.

Designs utilizing the ligament 306 layout of FIG. 5 additionally have a lower pressure drop associated with the cooling fluid traveling through the cooling fluid passage 110 than designs constructed according to the example ligament 306 layout of FIG. 3. The lower pressure drop is a result of the ligaments 306 having less interference with the fluid flow path 504 thereby reducing the amount of obstruction to fluid flow. The lower pressure drop additionally results in a lower heat transfer. The example embodiment of FIG. 5 could be used in any application where minimizing the pressure drop is a key design constraint. It is also known that alternate flow paths can be constructed by altering the angle of attack on some or all of the pins 112 in the pin array 300 thereby allowing the cooling fluid flow path to be differently controlled.

Although example embodiments of this invention have been disclosed, a worker of ordinary skill in this art would recognize that certain modifications would come within the scope of this disclosure. For that reason, the following claims should be studied to determine the true scope and content of this invention.

What is claimed is:

1. A heat exchanger comprising at least one stackable panel including at least one ligament portion, at least one pin having an airfoil profile, the at least one ligament portion having a smaller thickness along an axis perpendicular to an airfoil profile of said pin than a thickness of said at least one pin along an axis perpendicular to said airfoil profile of said pin.

2. The at least one stackable panel of claim 1, comprising a plurality of stacked panels wherein an end of said at least one pin contacts a pin of an adjacent stackable panel.

3. The at least one stackable panel of claim 2, wherein each of said stackable panels comprises a frame including a plurality of walls circumscribing said at least one pin portion, the at least one ligament portion connecting two of said plurality of walls, and said frame is at least as thick along an axis perpendicular to an airfoil profile of said pin as a thickness of said at least one ligament portion along an axis perpendicular to an airfoil profile of said pin.

4. The at least one stackable panel of claim 3, wherein each of said stacked panels comprises a plurality of pin portions having an airfoil profile located on said at least one ligament.

5. The at least one stackable panel of claim 3, comprising a plurality of stackable panels and each frame of said plurality of stackable panels interlocking with each adjacent panel.

6. The heat exchanger of claim 1, wherein said pin comprises a plurality of aligned layers such that said pin extends from said first thermally conductive wall to a second wall facing said first thermally conductive wall, and wherein each of said aligned layers is contained within a separate stackable panel.

* * * * *